US009509084B2

(12) United States Patent
Zhao et al.

(10) Patent No.: US 9,509,084 B2
(45) Date of Patent: Nov. 29, 2016

(54) WATERPROOF ELECTRICAL CONNECTOR AND METHOD FOR MAKING SAME

(71) Applicant: FOXCONN INTERCONNECT TECHNOLOGY LIMITED, Grand Cayman (KY)

(72) Inventors: Jun Zhao, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/086,076

(22) Filed: Mar. 31, 2016

(65) Prior Publication Data

US 2016/0294104 A1 Oct. 6, 2016

(30) Foreign Application Priority Data

Mar. 31, 2015 (CN) ..... 2015 1 0146483

(51) Int. Cl.

| | |
|---|---|
| ***H01R 13/52*** | (2006.01) |
| ***H01R 13/6581*** | (2011.01) |
| ***H01R 13/502*** | (2006.01) |
| ***H01R 43/00*** | (2006.01) |
| ***H01R 43/24*** | (2006.01) |

(52) U.S. Cl.

CPC ..... *H01R 13/5202* (2013.01); *H01R 13/502* (2013.01); *H01R 13/6581* (2013.01); *H01R 43/005* (2013.01); *H01R 43/24* (2013.01)

(58) Field of Classification Search

CPC ..... H01R 13/5202; H01R 13/52; H01R 13/6581; H01R 13/502; H01R 43/005

USPC ..... 439/271, 272, 587, 676, 660, 607.07, 439/607.09, 607.11, 607.13, 607.2, 607.32, 439/607.35, 607.53, 607.55

See application file for complete search history.

(56) References Cited

U.S. PATENT DOCUMENTS

| | | | | |
|---|---|---|---|---|
| 7,922,535 | B1 * | 4/2011 | Jiang | H01R 13/5205 439/271 |
| 8,025,530 | B2 * | 9/2011 | Abramov | H01R 13/5202 439/587 |
| 9,093,779 | B1 * | 7/2015 | Wang | H01R 13/521 |
| 9,437,956 | B2 * | 9/2016 | Fukami | B29C 70/72 |
| 2010/0261367 | A1 * | 10/2010 | Billman | H01R 13/65802 439/271 |
| 2013/0183844 | A1 * | 7/2013 | Wang | H01R 24/68 439/271 |
| 2014/0302709 | A1 | 10/2014 | Zhao et al. | |
| 2015/0044886 | A1 | 2/2015 | Little et al. | |
| 2015/0236441 | A1 | 8/2015 | Kim et al. | |
| 2015/0244099 | A1 | 8/2015 | Lee | |
| 2015/0325944 | A1 | 11/2015 | Chien et al. | |

FOREIGN PATENT DOCUMENTS

| | | |
|---|---|---|
| CN | 201146271 | 11/2008 |
| TW | M479538 | 6/2014 |

* cited by examiner

*Primary Examiner* — Abdullah Riyami
*Assistant Examiner* — Harshad Patel
(74) *Attorney, Agent, or Firm* — Wei Te Chung; Ming Chieh Chang

(57) ABSTRACT

An electrical connector includes: a terminal module including an insulative housing and a number of terminals insert molded with the housing, the housing including a base and a tongue extending forwardly from the base; a metallic shield enclosing the terminal module; and a sealing member positioned in front of the base and sealed between the terminal module and the shield. A related method of making includes: enclosing a metallic shield about a terminal module; inserting a terminal protector into a front mating port of the shield and module combination until abutting a part of the terminal module; and applying a sealing material via the front mating port into a space defined between the terminal module and the shield to form a sealing member.

9 Claims, 9 Drawing Sheets

WATERPROOF ELECTRICAL CONNECTOR AND METHOD FOR MAKING SAME

BACKGROUND OF THE INVENTION

1. Field of the Invention

The present invention relates generally to a waterproof connector and its manufacturing, and more particularly to a sealing member formed at or from a forward side of the connector.

2. Description of Related Arts

U.S. Patent Application Publication No. 2015/0236441 discloses a waterproof connector including a sealing member disposed and compressed between a block receiving body and a housing.

Sealing members or means for sealing between an outer body and an inner terminal-carrying housing of a connector are not known to be provided at or from a forward side thereof.

An improved waterproof connector is desired.

SUMMARY OF THE INVENTION

An object of the present invention is to provide a waterproof electrical connector which is reliable in structure and easy to make.

To achieve the above-mentioned object, an electrical connector comprises: a terminal module including an insulative housing and a number of terminals insert molded with the housing, the housing including a base and a tongue extending forwardly from the base; a metallic shield enclosing the terminal module; and a sealing member positioned in front of the base and sealed between the terminal module and the shield. A related method of making such a connector includes: enclosing a metallic shield about a terminal module; inserting a terminal protector into a front mating port of the shield and module combination until abutting a part of the terminal module; and applying a sealing material via the front mating port into a space defined between the terminal module and the shield to form a sealing member.

DETAILED DESCRIPTION OF THE PREFERRED EMBODIMENT

Figure 1:
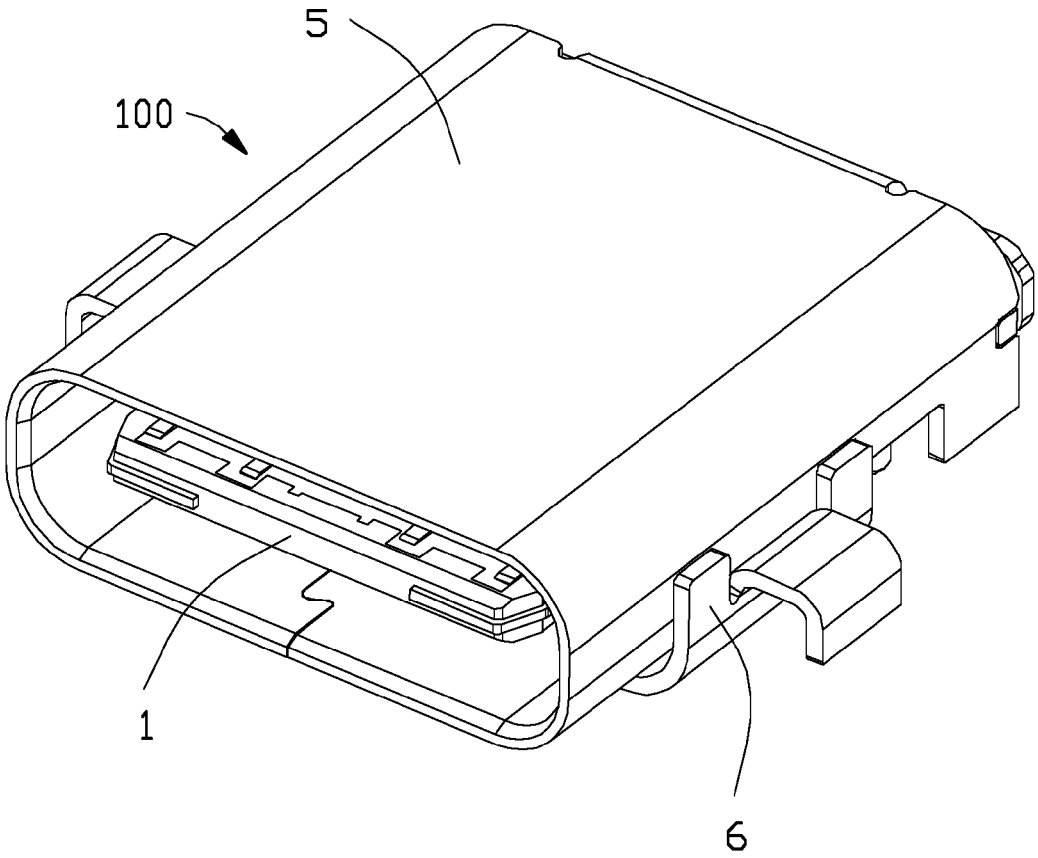
FIG. 1 is a perspective view of an electrical connector in accordance with the present invention.
Figure 2:
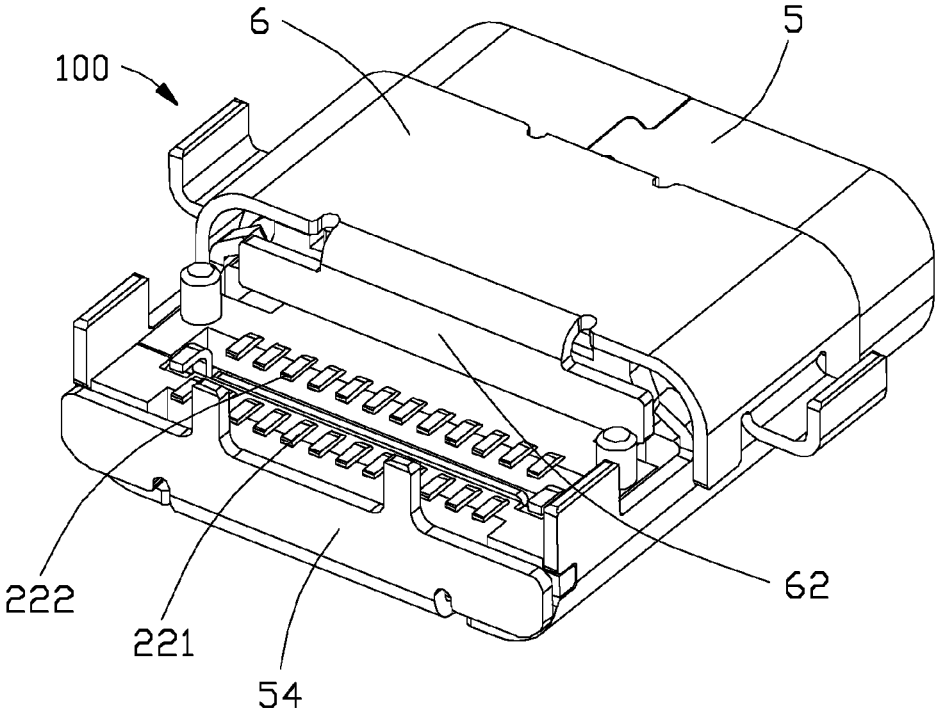
FIG. 2 is another perspective view of the connector in FIG. 1.
Figure 3:
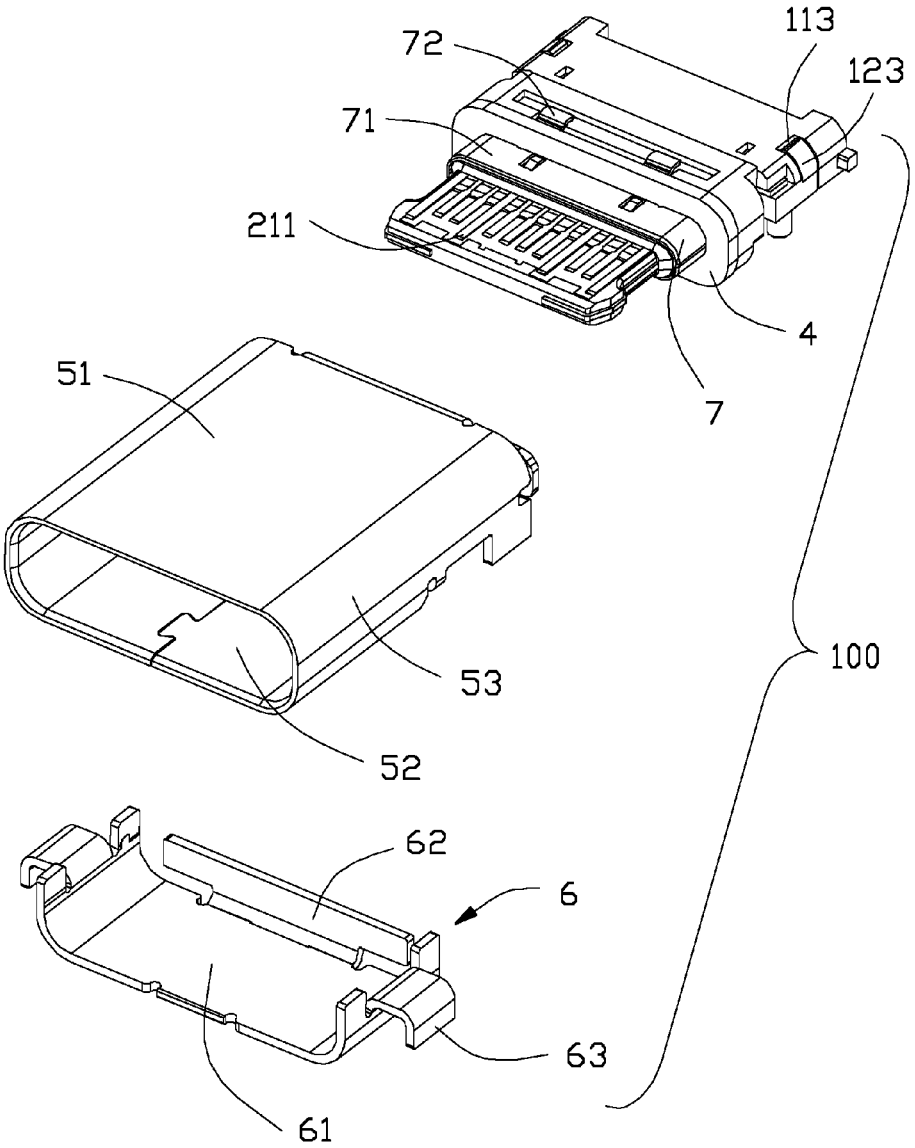
FIG. 3 is an exploded view of the connector in FIG. 1.
Figure 4:
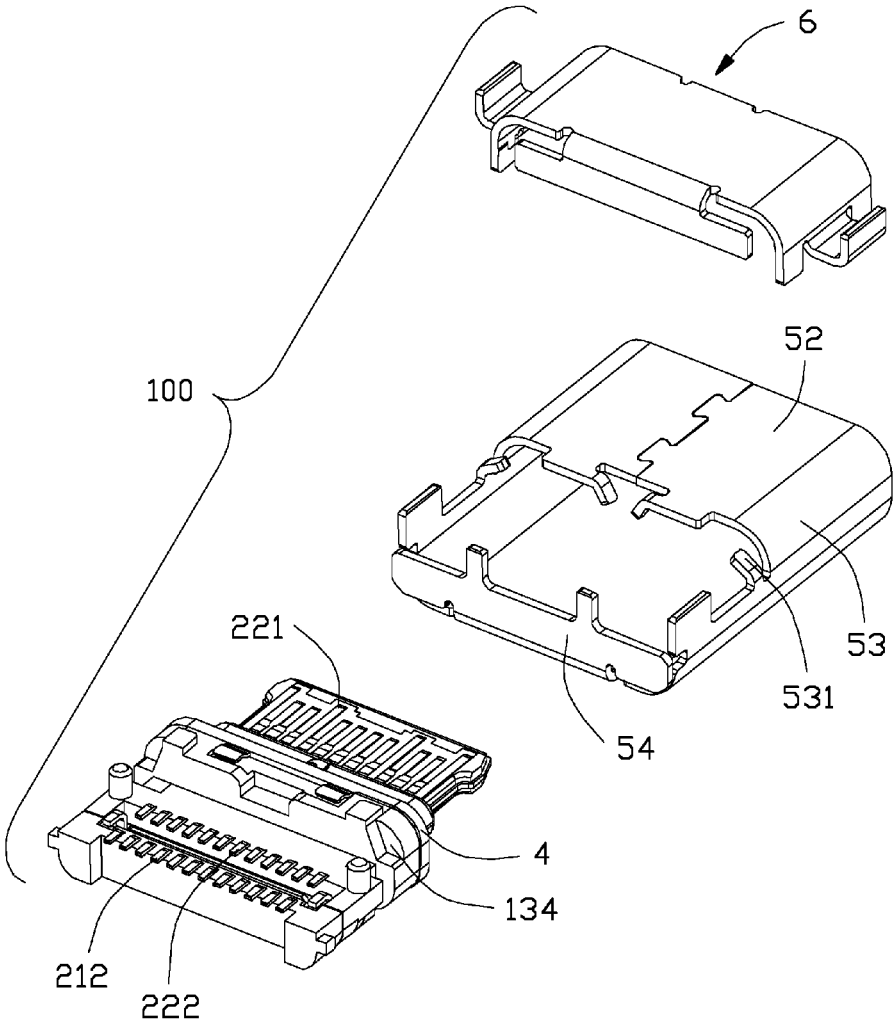
FIG. 4 is an exploded view of the connector in FIG. 2.

Referring to FIGS. 1 to 6, a waterproof electrical connector 100 in accordance with the present invention comprises a terminal module, a metallic shield 5 enclosing the terminal module, and a sealing member 4 sealed between the terminal module and the metallic shield 5. The terminal module may include an insulative housing 1, terminals secured to the housing 1, a middle shielding plate 3, a metallic EMI collar 7. The shield 5 define a front mating cavity or port with a tongue of the housing 1 therein for receiving a complementary connector. A metallic bracket 6 may be fixed to a bottom of the shield 5 for supporting purpose. The formation of the sealing member 4 in accordance with the present invention will be detailed later.

Figure 5:
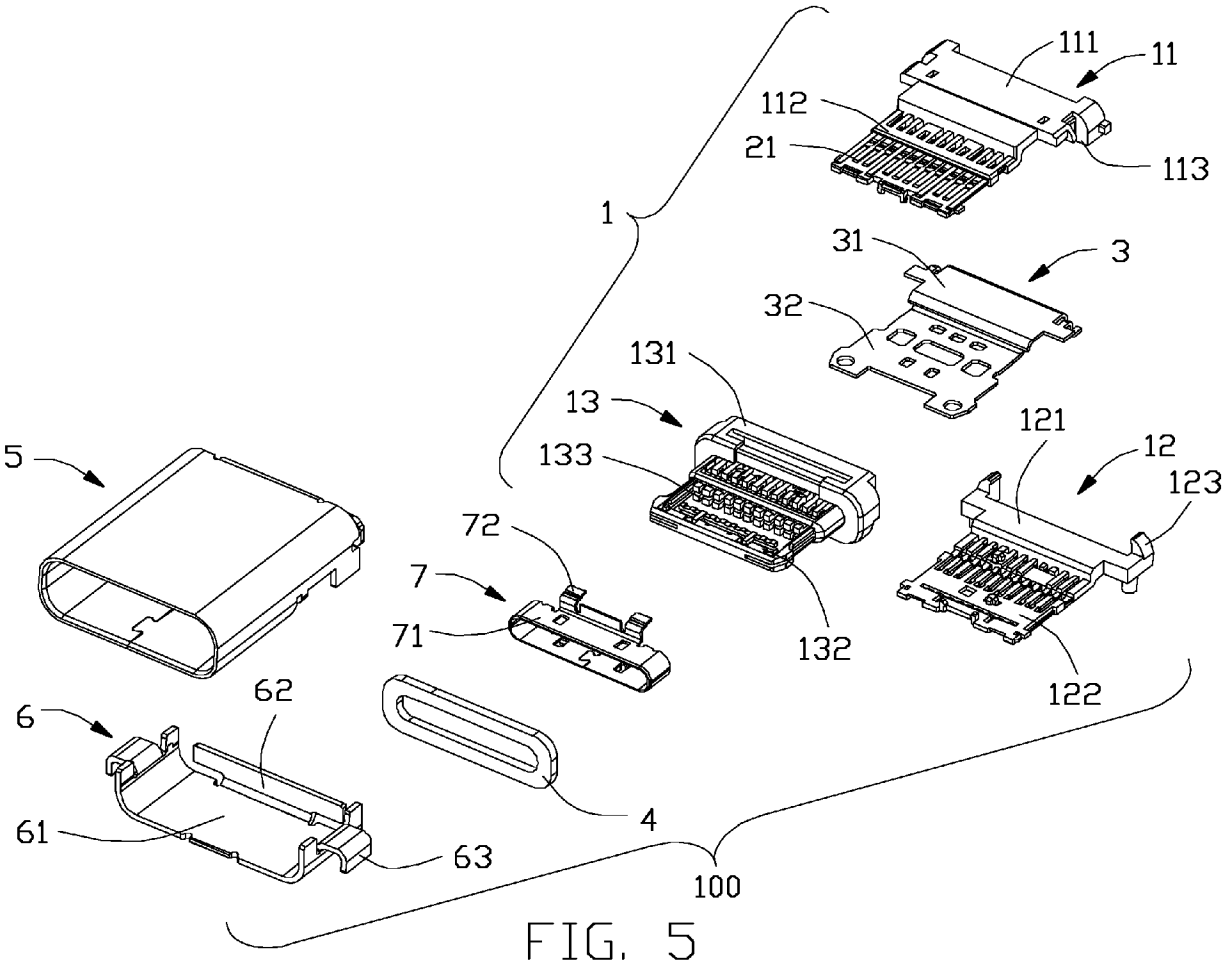
FIG. 5 is a further exploded view of the connector in FIG. 3.
Figure 6:
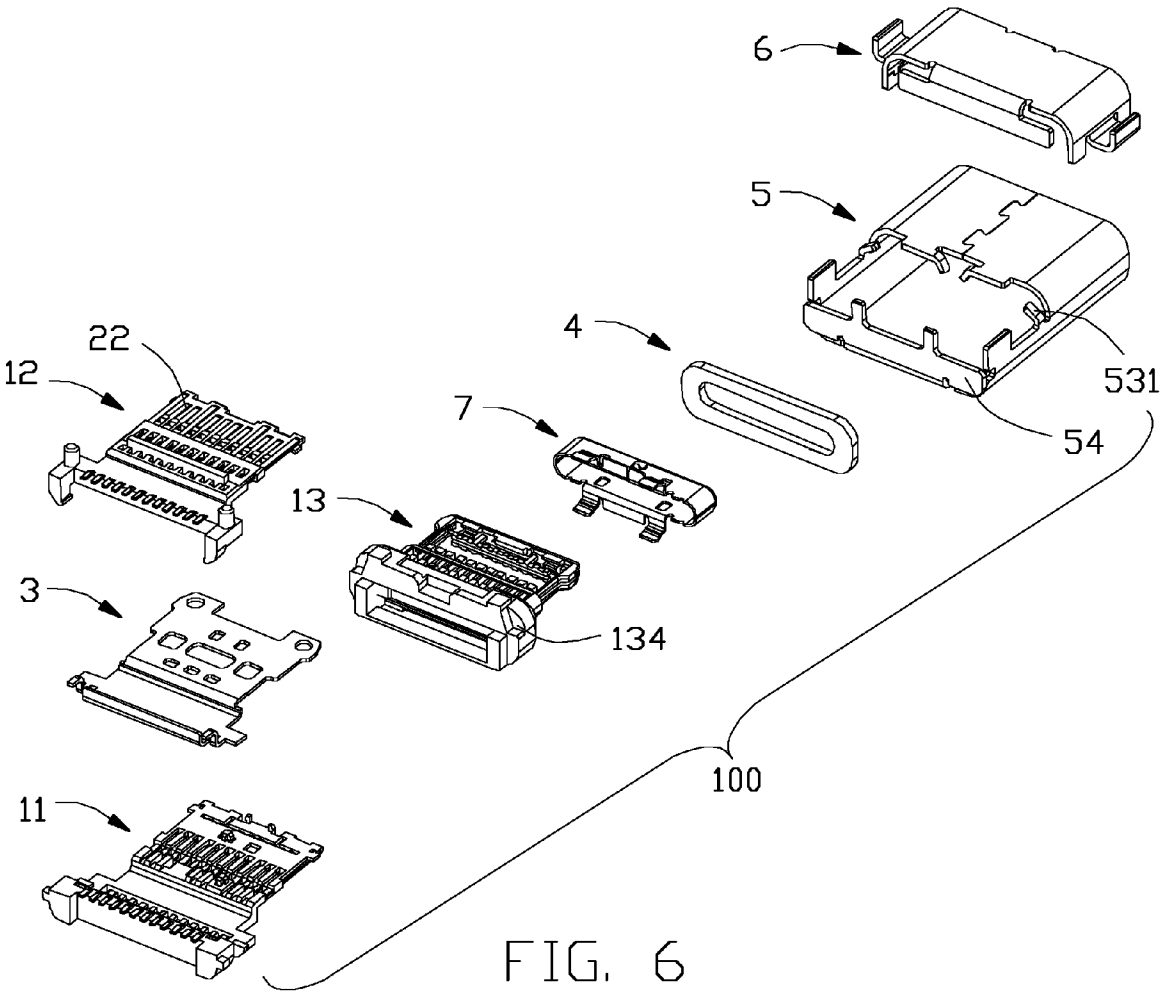
FIG. 6 is a further exploded view of the connector in FIG. 4.

As shown in FIGS. 5 and 6, the insulative housing 1 includes separately insert molded, first body 11, second body 12, and third body 13. The first body 11 has a base 111 and a tongue 112. Similarly, the second body 12 has a base 121 and a tongue 122; the third body 13 has a base 131 and a tongue 132. The third body 13 is insert molded at a second shot after the first body 11 is insert molded with associated terminals 21, the second body 12 is insert molded with associated terminals 22, and the middle shielding plate 3 is placed therebetween through engaging slot 113 and protrusion 123 structure. Associated terminals on the first and second bodies 11 and 12 are disposed within a space 133 at the tongue 132. Notably, the bases 111, 121 and 131 commonly form a complete base, and the tongues 112, 122 and 132 commonly form a complete tongue.

Each of the terminals 21 and 22 has a contacting portion 211 or 212 and a soldering portion 221 or 222. The terminals are so designed and arranged as to enable a reversible connector mating at two orientations. The soldering portions 221 and 222 are arranged on a same plane in two rows.

The middle shielding plate 3 has a base portion 31 and a tongue portion 32.

Referring again to FIGS. 3-6, the metallic shield 5 has a top wall 51, a bottom wall 52, a pair of side walls 53 between the top and bottom walls, and a rear wall 54 continuing the top wall but separate from the bottom wall. The side wall 53 has a leg 531 for engaging a notch 134 of the third body 13.

The metallic bracket 6 has an arcuate main portion 61, a baffle 62 extending from a rear of the main portion, and a pair of side board locks 63. The baffle 52 is positioned behind a rear of the bottom wall 52.

The metallic collar 7 has an annular main portion 71 and a plurality of fastening legs 72. The main portion 71 is mounted on a rear widened part of the tongue 132 of the third body 13.

Figure 7:
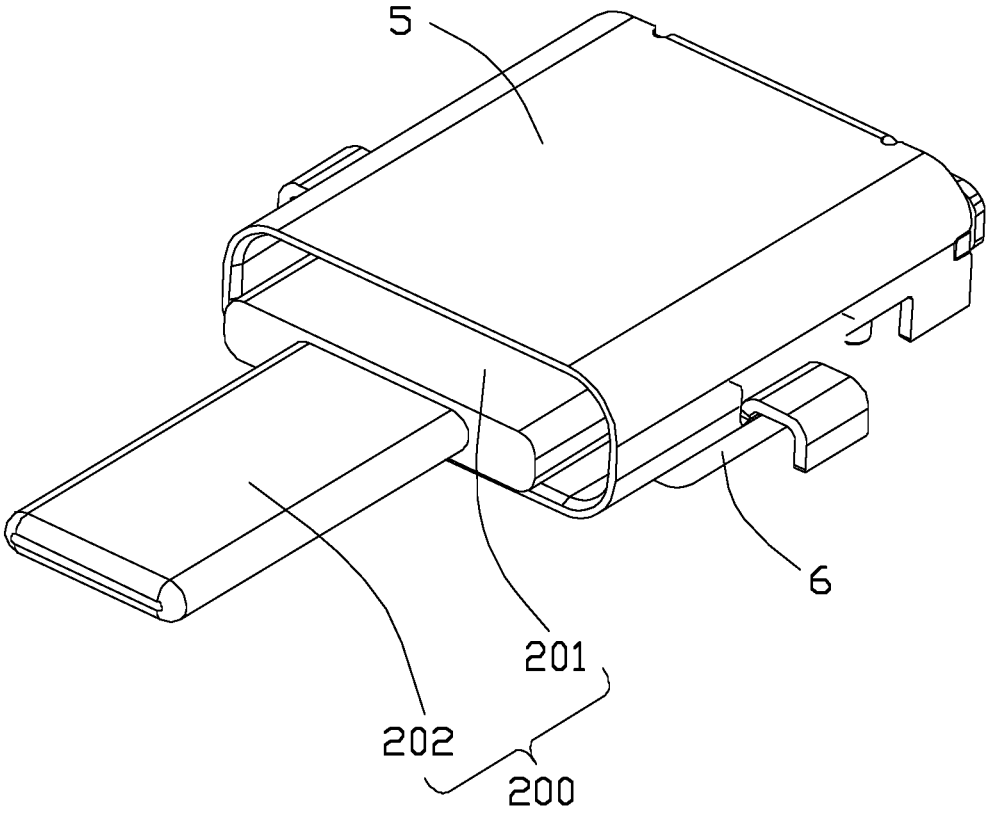
FIG. 7 shows a terminal protector for use in making the connector.
Figure 8:
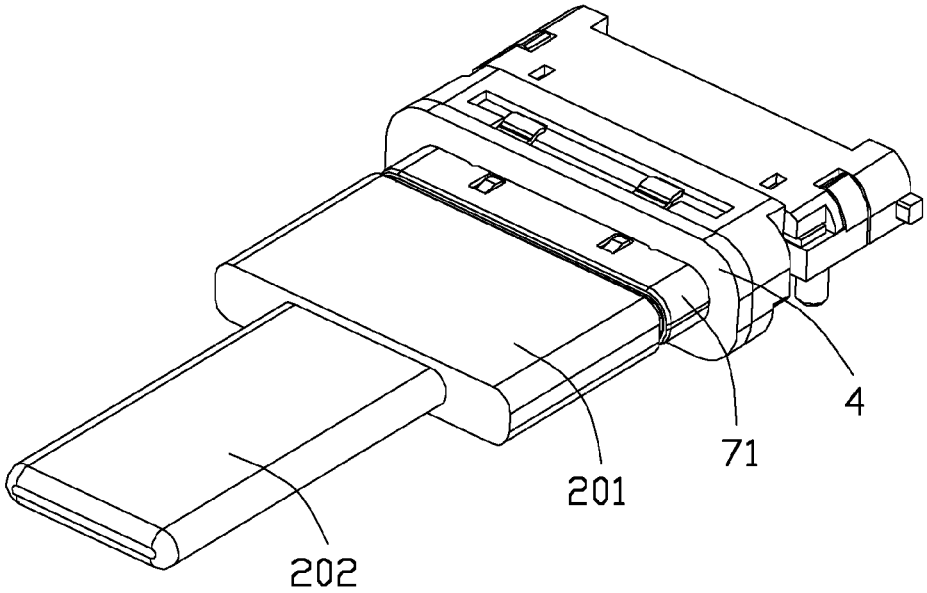
FIG. 8 is a view similar to FIG. 7 but omitting an outer shell of the connector for clarity purpose.
Figure 9:
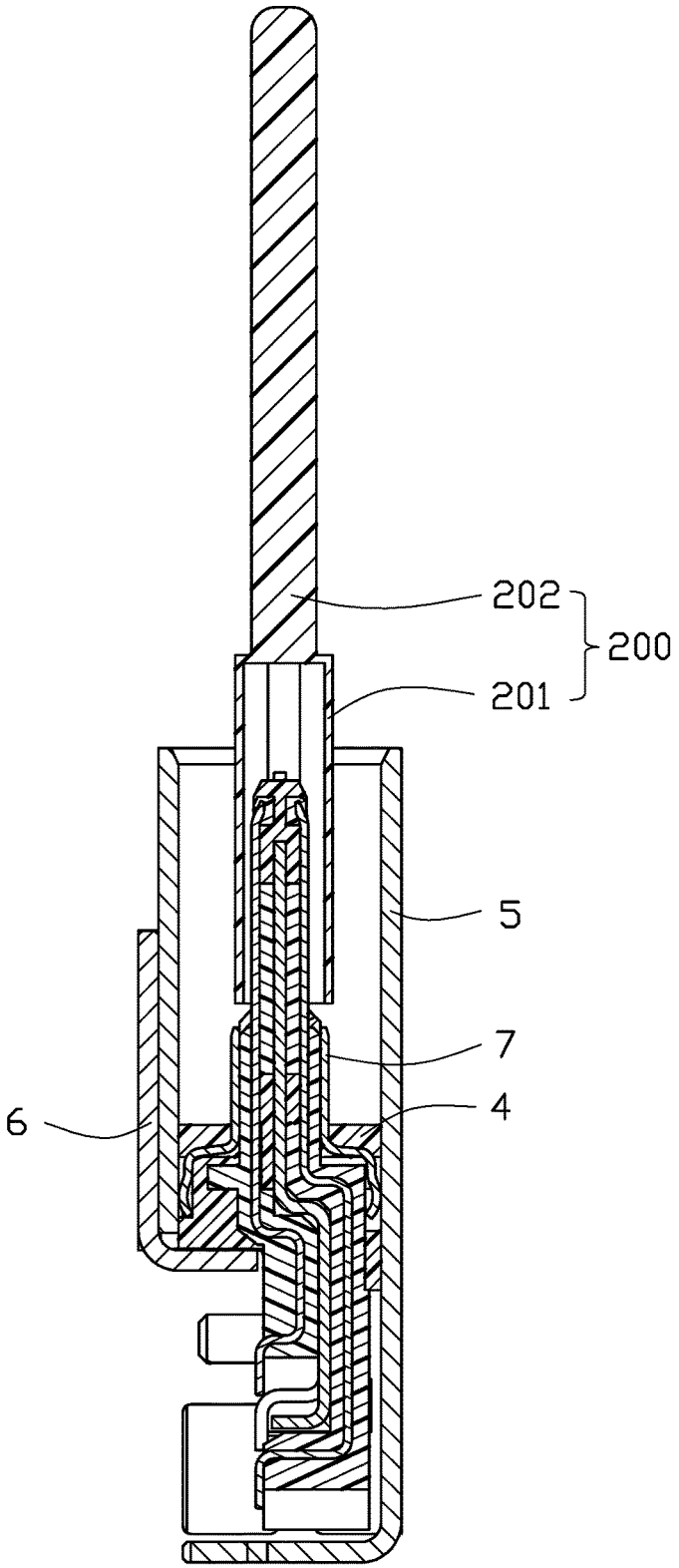
FIG. 9 is a cross-sectional view of the electrical connector with the protector attached thereon.

As shown in FIGS. 7 and 8, the terminal protector 200 has a protection portion 201 enclosing the tongue 132 of the third body 13 and a handle portion 202 extending outwardly. The portion 201 protects the terminal contacting portions 211 and 212 from contamination during forming the sealing member.

To form the sealing member 4 on a finished but otherwise not sealed connector, the protection portion 201 of the protector 200 is firstly positioned to enclose the tongue 132 of the insulative housing 1. A front of the protection portion 201 may abut a proximate end of the collar main portion 71 at this position. Then sealing material is poured into an annular space defined among the base 131, the tongue 132 (or the collar 7 if present), and the shield 5. This is advantageously done when the protector 200 is at an upright position, i.e., with the protection portion 201 at bottom. With the sealing material solidified, the sealing member 4 is formed and sealed between the third body 13 and the metallic shield 5. Therefore, the sealing member 4 is formed in front of the base 131 and between the tongue 132 and the shield 5. It is noted that the front mating opening or port defined by the inner housing 1 and the outer shield 5 is wide enough for easy flowing of the sealing material, which creates a high quality of the sealing member. The sealing material may suitably be glues or resins or the like. Understandably, in the embodiment the connector is of a horizontal type so the tongue is defined to extend forwardly/horizontally. Anyhow, another embodiment may show a vertical type in which the tongue is defined to upwardly extend. As noted, the feature of the invention is to provide the sealing member in the mating cavity, i.e., the front face of the base rather than the rear face of the base. In another embodiment, the sealing member may not be applied upon the root region of the tongue but only around the interference region between the base and the interior surface of the shield. In such a condition, the front face of the base may be formed with a peripheral/annular slot in the front face adjacent to the interior surface of the shield, and the sealing member is filled within such a peripheral slot while being spaced from the root region of the tongue.

What is claimed is:

1. An electrical connector comprising:

a terminal module including an insulative housing and a plurality of terminals disposed in the housing, the housing including a base and a tongue extending forwardly from the base;

a metallic shield enclosing the terminal module; and a sealing member positioned in front of the base and sealed between the terminal module and the shield, wherein said shield forms in front of the base, a mating cavity in which said tongue extends for mating with a complementary connector, and said base defines a front face directly forwardly facing the receiving cavity, wherein said tongue forms a rear widened part joined with said front face of the base, and the sealing member closely surrounds the widened part; and a metallic collar is attached upon the widened part, and said sealing member is intimately attached upon said collar.

2. The electrical connector as claimed in claim 1, wherein said terminals are insert-molded within the housing.

3. The electrical connector as claimed in claim 2, further comprising the metallic collar, and wherein the tongue has a rear widened part on which the collar is mounted.

4. The electrical connector as claimed in claim 3, wherein the base, the metallic collar, and the shield together define an annular space and the sealing member is formed in the annular space.

5. The electrical connector as claimed in claim 1, wherein said sealing member is further intimately attached upon the front face of the base.

6. The electrical connector as claimed in claim 5, wherein said sealing member is further attached upon an interior surface of the shield around said front face of the base.

7. An electrical connector assembly comprising:

an insulative housing including a base;

a plurality of terminals disposed in the base;

a metallic shield assembled to the base in a surrounding manner and forming a mating cavity located in front of said base and forwardly communicating with an exterior along a front-to-back direction;

a sealing member disposed in the mating cavity around a front face of said base to seal a gap between an interior surface of the shield and a corresponding outer surface of the housing in a transverse direction perpendicular to said front-to-back direction, wherein said gap is annular, and said sealing member is annular, wherein said housing further includes a tongue unitarily extending forwardly from the base in the front-to-back direction, and said annular gap is located around a root region of the tongue, wherein a metallic collar surrounds the root region of the tongue, and the sealing member is attached upon the interior surface of the shield, the front face of the base and the collar.

8. The electrical connector assembly as claimed in claim 7, further including a protector detachably attached upon the tongue to flow the liquid sealing material into the mating cavity to form the annular sealing member.

9. The electrical connector assembly as claimed in claim 7, wherein said root region of the tongue is widened compared with a front region of the tongue.

* * * * *